United States Patent [19]

Sheu et al.

[11] Patent Number: 4,967,578

[45] Date of Patent: Nov. 6, 1990

[54] SLEEVE-TYPE LATCH BOLT MECHANISM

[76] Inventors: Yig-Chip Sheu, No. 169, Chi-Lin St.; Sheen-An Way, No. 137, Shen-Yang St., both of San-Min Dist., Kaohsiung City, Taiwan

[21] Appl. No.: 434,780

[22] Filed: Nov. 13, 1989

[51] Int. Cl.[5] ..... E05B 27/00

[52] U.S. Cl. ..... 70/491; 70/387

[58] Field of Search ..... 70/351, 345, 369, 382–384, 70/387, 403, 404, 409, 491

[56] References Cited

U.S. PATENT DOCUMENTS

| | | | |
|---|---|---|---|
| 2,036,738 | 4/1936 | Zygmunt | 70/491 |
| 2,391,834 | 12/1945 | Johnstone | 70/491 |
| 2,424,514 | 7/1947 | Sterner | 70/383 |
| 3,817,066 | 6/1974 | Pearson | 70/491 |

FOREIGN PATENT DOCUMENTS

| | | | |
|---|---|---|---|
| 2313526 | 12/1976 | France | 70/491 |
| 40436 | 4/1937 | Netherlands | 70/491 |

*Primary Examiner*—Gary L. Smith
*Assistant Examiner*—Suzanne L. Dino
*Attorney, Agent, or Firm*—Oblon, Spivak, McClelland, Maier & Neustadt

[57] ABSTRACT

A sleeve-type latch bolt mechanism includes: a cylindrical body with an annular member and a check block formed at one end, a round keyhole in the middle, a plurality of vertical grooves and slots positioned along the cylindrical body in communication with the round keyhole; a latch device composed of a plurality of front and rear latch members, each with a reference slot and a plurality of dummy slots in one side and a check piece in another side, respectively, disposed in the vertical grooves of the cylindrical body with the check pieces extending into the round keyhole; a plurality of different circular positioning members each with a plurality of check lugs separately disposed around the cylindrical body; a front and a rear sleeve member installed around the outside of the cylindrical body and engaged with the circular positioning members; and a cylindrical-stem key having a stem provided with a plurality of different slots or step-type strips therearound in conjunction with the locations of the check pieces of the latch members, for being inserted into the keyhole of the cylindrical body for performing unlocking and locking operations therewith.

6 Claims, 5 Drawing Sheets

SLEEVE-TYPE LATCH BOLT MECHANISM

BACKGROUND OF THE INVENTION

1. Field of the Invention

This invention relates to a latch bolt mechanism, and particularly to a sleeve-type latch bolt mechanism having different latch members arranged in a cylindrical lock-core device and a cylindrical-stem key adapted to ensure effective locking security.

2. Discussion of the Background

Conventionally, most latch bolt mechanisms are constructed with identical latch members, which are combined together and have a keyhole formed therein for being operated by a serrated flat key to effect unlocking or locking operations therewith. This type of known latch bolt mechanism lacks variety and can be easily unlocked by unauthorized persons with flat articles similar to the latch-bolt key. Therefore, locks combined with these conventional latch bolt mechanisms are insecure and can be the cause of considerable property loss.

SUMMARY OF THE INVENTION

It is accordingly a primary object of the present invention to provide a sleeve-type latch bolt mechanism with a lock-core device having a cylindrical body structure formed with a plurality of vertical and annular grooves for accommodating different latch members therein so as to achieve a double locking effect and ensure locking security therewith.

It is another object of the present invention to provide a sleeve-type latch bolt mechanism with a latch device composed of different latch members, each having a reference slot formed in one side thereof for effecting variation in the locations of said latch members so as to minimize the duplication of latch bolt mechanisms and the related keys thereof for increasing locking security.

It is a further object of the present invention to provide a sleeve-type latch bolt mechanism with a cylindrical-stem key having various slots and step-type strips formed in conjunction with said different latch members so as to achieve the highest safety effect therewith.

It is still another object of the present invention to provide a sleeve-type latch bolt mechanism with different latch members each one of which is provided with a plurality of dummy slots so as to misguide any attempted unlocking operations by unauthorized persons and ensure the safety locking effect of the latch bolt mechanism.

These and other objects of the present invention are achieved by the provision of a sleeve-type latch bolt mechanism which comprises a combination of a lock-core device, a latch device, positioning means, a front sleeve member, a rear sleeve member and a cylindrical-stem key. The lock-core device includes: a cylindrical body having an annular member and a check block formed at one end thereof; a round keyhole provided in the middle portion thereof; a plurality of vertical grooves separately provided along the periphery thereof; an elongated slot located in each of said vertical grooves in communication with the round keyhole of said cylindrical body; and a plurality of circular slots respectively located around the cylindrical body. The latch device includes a plurality of front and rear latch members each one of which is provided with a reference slot and a plurality of dummy slots in one side thereof and a check piece provided in another side thereof, and a plurality of elastic members attached at one end thereof, respectively disposed in the vertical grooves of said cylindrical body. The positioning means is composed of different circular positioning members, each of which is formed with a plurality of exterior and interior check lugs, separately disposed in said circular slots of said cylindrical body for being respectively engaged with the front and rear sleeve members. The front sleeve member, which is formed with different bores and check slots therein, is disposed around the cylindrical body with said check slots being engaged with the outside check lugs of said circular positioning members for keeping each circular member in position in the circular slots. The rear sleeve member is provided with a closed side at one end thereof and an open side at another side thereof, having a keyhole formed in said closed side in conjunction with the keyhole of said cylindrical body, and installed at the rear end of said cylindrical body. The cylindrical-stem key includes a stem having a plurality of different slots or step-type strips provided at the front portion thereof in conjunction with the locations of said latch members for being inserted into the keyhole of said cylindrical body for performing unlocking and locking operations therewith. As a result, when the combined latch bolt mechanism is installed in a lock body, unlocking and locking operations can be effected only by said corresponding cylindrical-stem key, thus achieving the highest locking security therewith.

Other advantages and characteristics of the present invention will become apparent from the following detailed description of a preferred embodiment when read in conjunction with the accompanying drawings.

DETAILED DESCRIPTION OF THE PREFERRED EMBODIMENTS

Figure 1:
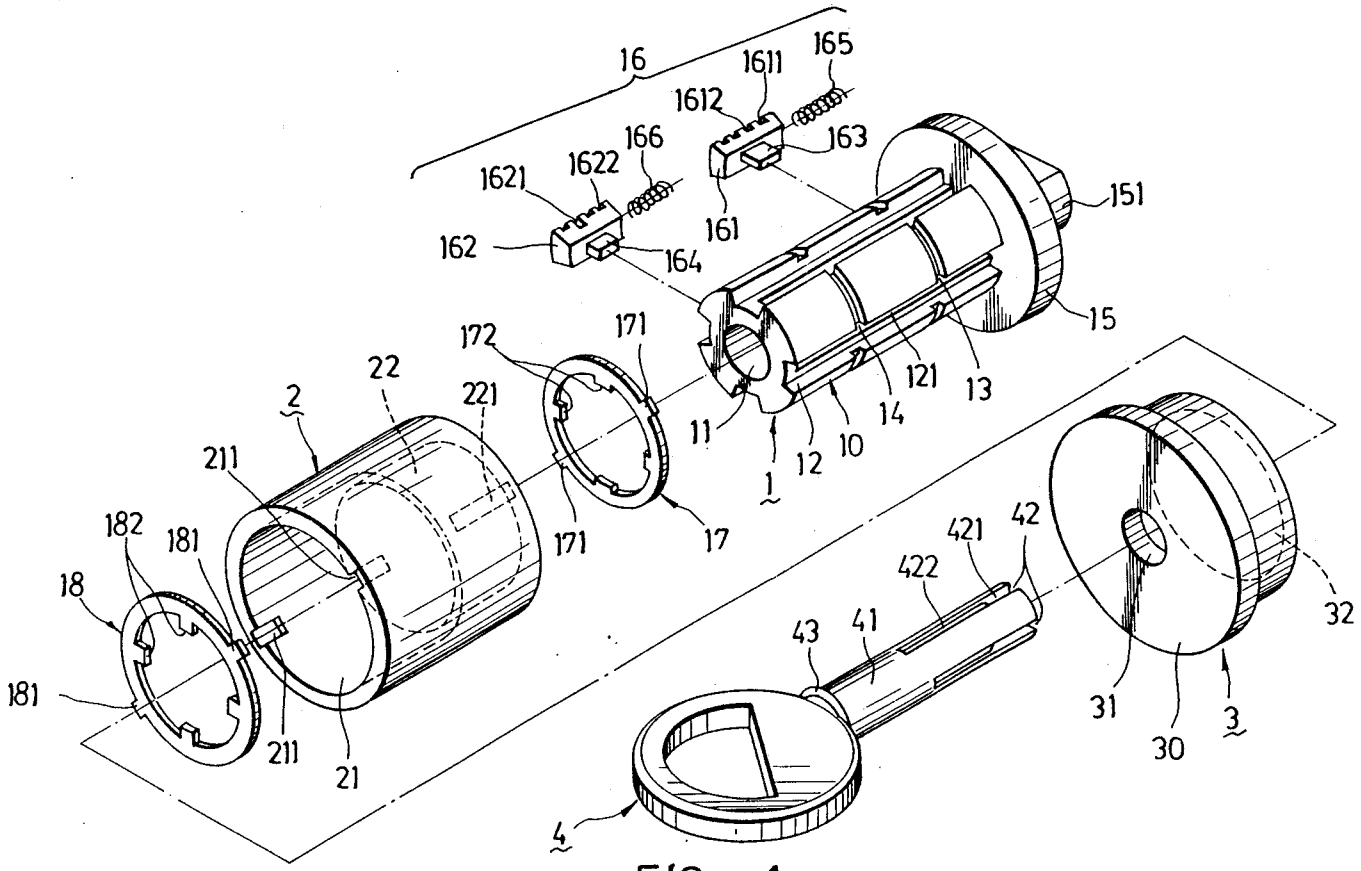
FIG. 1 is a perspective and exploded view of the preferred embodiment of a sleeve-type latch bolt mechanism according to the present invention.

Referring to FIG. 1, the preferred embodiment of a sleeve-type latch bolt mechanism according to the present invention comprises a combination of a lock-core device 1, a latch device 16, positioning means, a front sleeve member 2, a rear sleeve member 3, and a cylindrical-stem key 4.

The lock-core device 1 is composed of a cylindrical body 10 which includes: a round keyhole 11 vertically formed in the middle portion thereof; a plurality of vertical grooves 12 respectively provided around the periphery thereof wherein each of said vertical grooves 12 has an elongated slot 121 located in the center thereof in communication with said round keyhole 11; a first and a second circular groove 13, 14 separately located in the front and rear portions thereof; an annular block 15 provided at the front end thereof; and a check member 151 fixedly provided on the top surface of said annular block 15 for being movably engaged with a shackle of a lock body, (not shown in FIG. 1).

Figure 2:
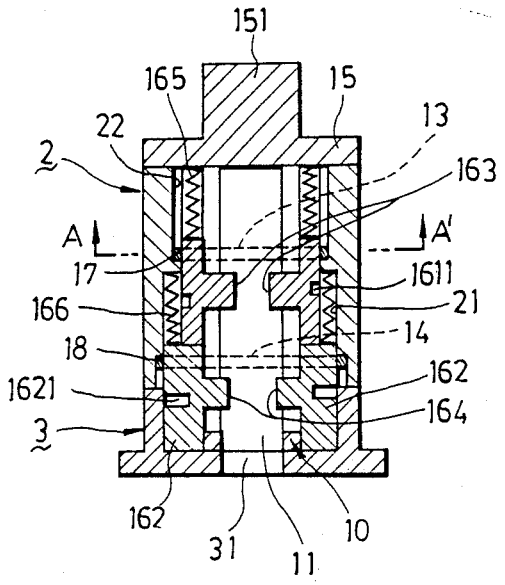
FIG. 2 is a sectional view of the combined preferred embodiment shown in FIG. 1.
Figure 3:
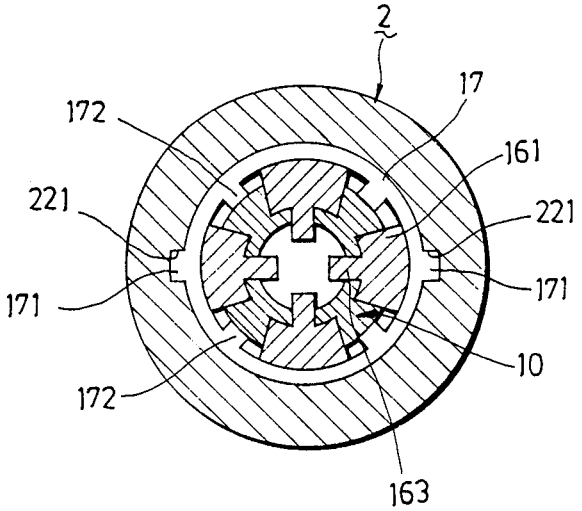
FIG. 3 is a cross sectional view of the combined preferred embodiment taken along Line A—A' of FIG. 2.

Referring to FIGS. 2 and 3 in connection with FIG. 1, the latch device 16 comprises: a plurality of front latch members 161, (only one being shown), and a plurality of rear latch members 162, (only one being shown), wherein the cross section of said front latch members 161 is larger than that of said rear latch members 162, and each one of said front and rear latch members 161, 162 is provided with a check piece 163, 164 at the back side thereof, a reference slot 1611, 1621, together with a plurality of dummy slots 1612, 1622 positioned parallel with said reference slots 1611, 1621, located at the front side thereof; and a plurality of first and second springs 165, 166 separately attached to each front end thereof. The front and rear latch members 161, 162 are respectively disposed, via the back side thereof, in the front and rear portions of said vertical grooves 12 of said cylindrical body 10 with the check pieces 163, 164 of the front and rear latch members 161, 162 separately extending into the round keyhole 11 through said elongated slots 121 of said vertical grooves 12 wherein the first and second springs 165, 166 are separately installed between every two latch members 161, 162, as shown in FIG. 2. It is to be noted that since the cross section of each front latch member 161 is larger than that of each rear latch member 162, the extended length of the check pieces 163 of said front latch members 161 is greater than that of the check pieces 164 of said rear latch members 162 within the round keyhole 11 of said cylindrical body 10.

As shown in FIGS. 1 and 2, the positioning means includes a first and a second annular positioning member 17, 18, each of which is formed with a pair of outside check lugs 171, 181 extending in opposite directions at the outer perimeters thereof and a plurality of inside check lugs 172, 182 opposingly extending at the inside perimeters thereof, and each of which is separately disposed around the first and second circular grooves 13, 14 of said cylindrical body 10. In addition, the diameter of said first annular positioning member 17 is smaller than that of said second annular positioning member 18 so as to be properly engaged with the different bores of said front sleeve member 2.

The front sleeve member 2, which is in the shape of a hollow cylinder with a larger bore 21 formed in the rear portion thereof and a smaller bore 22 formed in the front portion thereof, is sleeved around said cylindrical body 10 wherein the inner walls of said larger and smaller bores 21, 22 are separately provided with a first pair and a second pair of locating slots 221 , 211 for being respectively engaged with the outside check lugs 171, 181 of said first and second annular positioning members 17, 18, wherein the inside check pieces 172, 182 are respectively located in the front and rear circular grooves 13, 14 of said cylindrical body 10 so that said first and second annular positioning members 17, 18 are kept in position therein and cannot be turned in the front sleeve member 2 along with the cylindrical body 10, as partially shown in FIG. 3.

As shown in FIGS. 1, 2 and 3, the rear sleeve member 3, which is formed with a larger closed end 30 having a round keyhole 31 provided therein corresponding to the round keyhole 11 of said cylindrical body 10 and a smaller open end 32 provided in conjunction with said front sleeve member 2, is disposed around the rear end of said cylindrical body 10, as shown in FIG. 2.

As shown in FIG. 1, the cylindrical-stem key 4 according to the present invention includes: a key stem 41 constructed in conjunction with the round keyholes 11, 31 of said cylindrical body 10 and said rear sleeve member 3; a plurality of vertical openings 42 separately provided around the front portion of said stem 41 in conjunction with the elongated slots 121 of said cylindrical body 10 wherein each one of said vertical openings 42 is formed with a deep portion 421 in the front end thereof and a shallow portion 422 in the rear end thereof, each deep portion 421 and each shallow portion 422 being different in length so as to match the locations of the various check pieces 163, 164 of said front and rear latch members 161, 162 which are unevenly positioned in the vertical grooves 12 of said cylindrical body 10 according to the reference slots 1611, 1621 respectively provided on the front side of each of the front and rear latch members 161, 162; and a stop ring 43 provided at a rear end of the stem 41 wherein the outside diameter of said stop ring 43 is larger than the inside diameter of the round keyhole 31 of said rear sleeve member 3.

After the preferred embodiment of FIG. 1 is assembled, as shown in FIG. 2, the first and second annular positioning member 17, 18 are separately located in said front sleeve member 2 with said first annular positioning member 17 being aligned with the first circular groove 13 and said second annular positioning member 18 being aligned with the second circular groove 14 of said cylindrical body 10. In addition, the first springs 165 are located between the annular block 15 of said cylindrical body 10 and the front latch members 161 within the smaller bore 22 of said front sleeve member 2, while the second springs 166 are situated between the rear latch members 162 and the inner edge of the larger bore 21 of said front sleeve member 2. It should be appreciated that, under normal conditions, (i.e. before the cylindrical-stem key 4 is inserted into the round keyhole 11 of said cylindrical body 10), the reference slots 1611, 1621 of said front and rear latch members 161, 162 are not evenly positioned in the vertical grooves 12 around said cylindrical body 10.

As shown in FIGS. 2 and 3, which is taken along Line A—A' of FIG. 2, the inside check lugs 172 of said first annular positioning member 17 are respectively located in the first circular groove 13 of said cylindrical body 10 between the two bordering front latch members 161 so as to check the turning movement of both the front latch members 161 and the cylindrical body 10. Similarly, the inside check lugs 182 of said second annular positioning member 18 are respectively located in the second circular groove 14 of said cylindrical body 10 between the two bordering rear latch members 162 so as to check the turning movement of both the rear latch members 162 and the cylindrical body 10. Therefore, a double check action for the lock-core device 1 is achieved to ensure locking security therewith.

Figure 4:
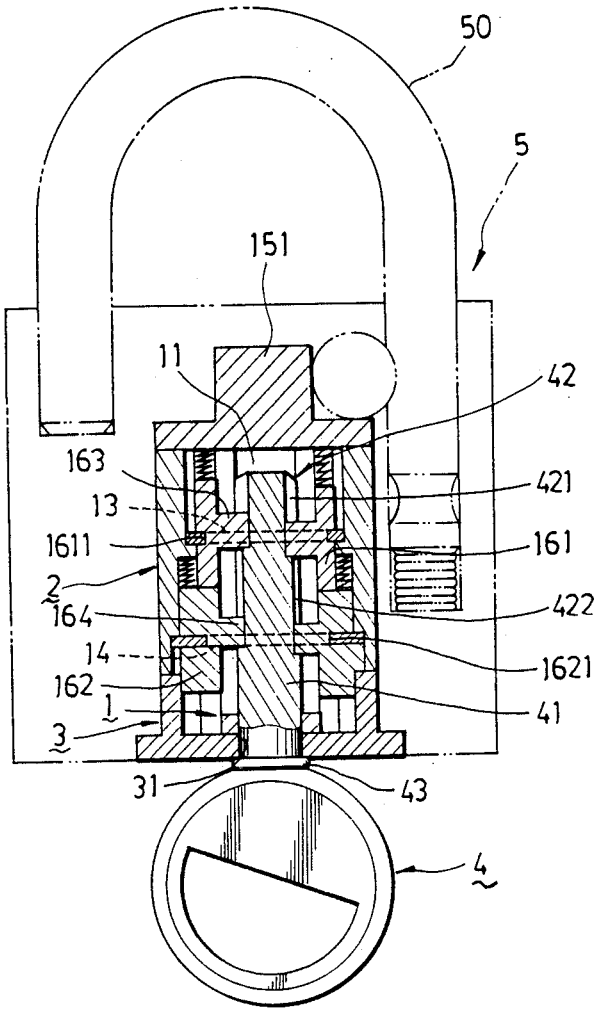
FIG. 4 is a sectional illustrative view showing the unlocking and locking operations of the preferred embodiment of FIG. 1.

Referring to FIG. 4 in connection with FIG. 1, when the cylindrical-stem key 4 is inserted into the round keyhole 11 via the keyhole 31 of the preferred embodiment which is installed in a lock body 5, the check pieces 164 of said rear latch members 162 will allow the deep portions 421 of the key stem 41 to pass through until the check pieces 163 of said front latch members 161 are reached. When the stem 41 is continuously pushed forward into the round keyhole 11 of said cylindrical body 10 until the stop ring 43 impinges upon the top surface of said rear sleeve member 3, the front and rear latch members 161, 162 will be respectively pressed forward against the front and rear springs 165, 166, by the deep and shallow portions 421, 422 of said stem 41, against the check pieces 163, 164 of both latch members 161, 162. At this stage, the reference slots 1611 for all of the front latch members 161 and the reference slots 1621 for each of the rear latch members 162 will be respectively located at the first and second annular grooves 13, 14 of said cylindrical body 10 so that the front and rear annular positioning members 17, 18, together with the reference slots 1611, 1621 of both front and rear latch members 161, 162 are located at the same level, resulting in the freeing of the front and rear latch members 161, 162 from the checking action of said first and second annular positioning members 17, 18, allowing said front and rear latch members to be turned thereat. Meanwhile, said cylindrical body 10, together with the check block 151, which is movably engaged with the shackle 50 of the lock body 5, can also be turned within the front and rear sleeve members 2, 3 by the stem 41 of said cylindrical-stem key 4 for effecting unlocking or locking operations.

Figure 5:
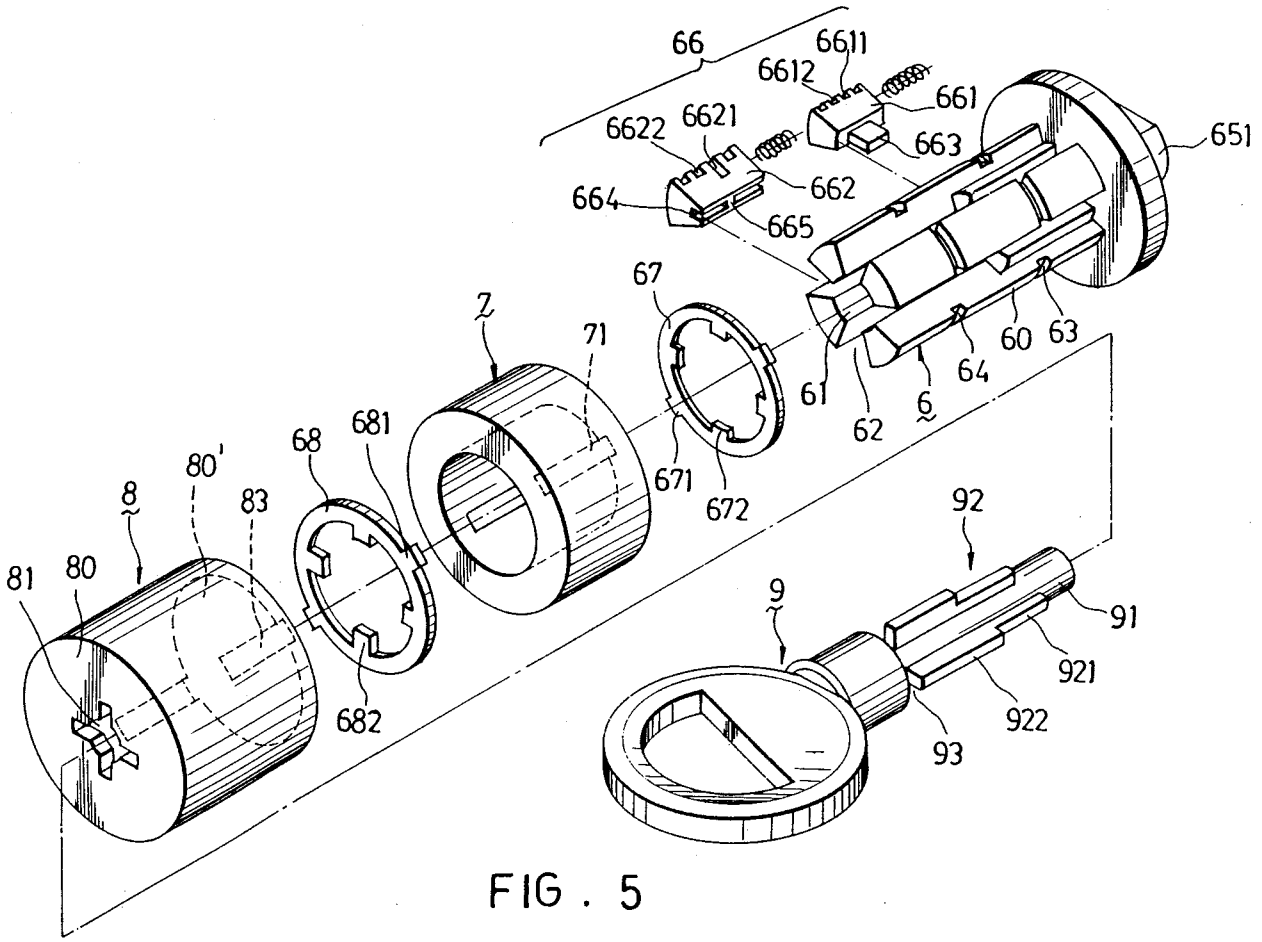
FIG. 5 is a perspective and exploded view of an alternative example of the preferred embodiment according to the present invention.

Referring to FIG. 5, an alternative example of the preferred embodiment of a sleeve-type latch bolt mechanism according to the present invention is shown wherein the structure of the lock-core device 6 is the same as that of the lock-core device 1 of the first preferred embodiment except that the upper portion of each vertical groove 62 in the cylindrical body 60 is open to the round keyhole 61. The latch device 66 is also the same as the latch device 16 of the first embodiment with a plurality of front and rear latch members 663, 664 each of which also includes a reference slot 6611, 6621 and a plurality of dummy slots 6612, 6622, (which are designed to misguide a thief who tries to unlock the bolt mechanism without the keys especially designed for the latch bolt mechanism), with the exception of the rear latch members 662, each one of which is formed with a notch 664 in the back side thereof and a check piece 665 located in said notch 664. The first and second annular positioning members 67, 68 are also the same as those of the first embodiment. As to the front and rear sleeve members 7, 8, the outside diameter of both members 7, 8 are identical but the inside diameter of said rear sleeve member 8 is larger than that of said front sleeve member 7 so as to accommodate the different first and second annular positioning members 67, 68 therein when both sleeve members 7, 8 are disposed around the cylindrical body 60 of said lock-core device 6. In addition, said front sleeve 7 is an open sleeve having a slot 71 formed in the inner wall thereof for being engaged with the outside check lug 671 of said first annular positioning member 67, and said rear sleeve member 8 includes a closed side 80 having a multi-opening keyhole 81 formed therein and an open side 80' having a slot 83 provided in the inner wall thereof for being engaged with the outside check piece 681 of said second annular positioning member 68.

As shown in FIG. 5, the cylindrical-stem key 9 for this alternative example is constructed in conjunction with the front and rear latch members 661, 662 of said latch device 66. The stem 91 is provided with a plurality of step-type strips 92 each of which includes a lower front portion 921 and a higher rear portion 922, the length of each front and rear portions 921, 922 differing in conjunction with the locations of the check pieces 663, 665, as well as with the reference slots 6611, 6621 of said front and rear latch members 661, 662. In addition, the stem 91 of said cylindrical-stem key 9 includes a circular opening 93 formed at the top of the rear portion 922 of said step-type strips 92 with the space of said circular opening 93 being wider than the thickness of the closed side 80 of said rear sleeve member 8 so that when the stem 91 is inserted into the keyhole 61 of said cylindrical body 60, turning movement of said stem 91 can be easily made therein for performing unlocking and locking operations.

Figure 6:
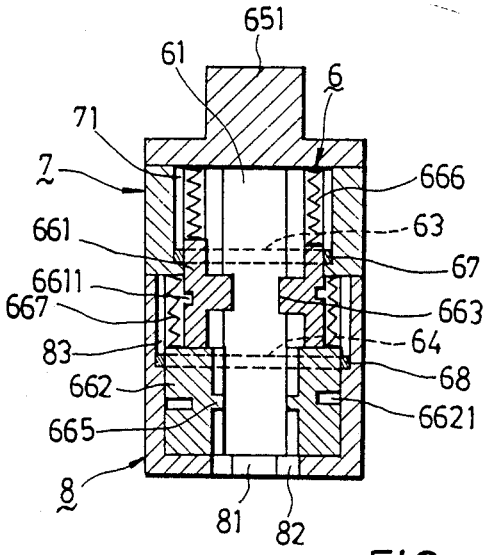
FIG. 6 is a sectional view of the combined preferred embodiment shown in FIG. 5.
Figure 7:
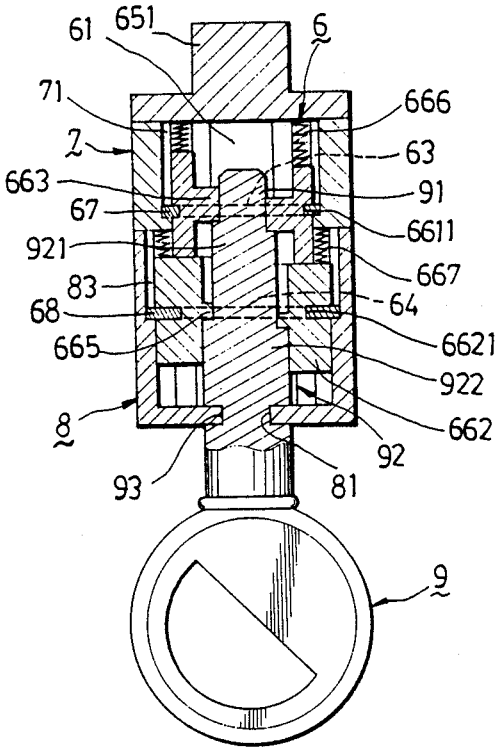
FIG. 7 is a sectional illustrative view showing the unlocking and locking operations of the preferred embodiment of FIG. 5.

Referring to FIGS. 6 and 7, the assembled condition of the alternative embodiment, as shown in FIG. 6, is the same as that of the first embodiment shown in FIG. 2. When the stem 91 is inserted into the keyhole 61 through the multi-opening keyhole 81, as shown in FIG. 8, the front lower portions 921 of the step-type strips 92 will pass through the rear latch members 662 and impinge upon the check pieces 663 of the front latch members 661. When the key stem 91 is pressed forward, the lower portions 921 and the higher portions 922 of said step-type strips 92 will respectively push the front and rear latch members 661, 662 forward until the reference slots 6611, 6621 of said front and rear latch members 661, 662 are separately located at the first and second circular grooves 63, 64, so that both latch members 661, 662 are disengaged with the inside check lugs 672, 682 of said front and rear annular positioning members 67, 68 and can be turned thereat. Therefore, by turning the cylindrical-stem key 9, the cylindrical body 60, together with the check block 651, will be turned to effect unlocking or locking operations.

The present invention comprises the following features:

(1) The reference slots (1611, 1621 ; 6611, 6621) provided in each front side of said front and rear latch members (161, 162; 661, 662;), together with the corresponding vertical openings (42) and step-type strips (92) of the cylindrical-stem keys (4; 9), can be optionally changed so as to minimize the duplication of the lock-core devices (1; 6) and the round-bar keys (4; 9) thus achieving the highest lock security therewith.

(2) In addition to said reference slots, each of said front and rear latch members is also provided with a plurality of dummy slots so as to misguide any unlocking operations by unauthorized persons and increase the safety effect therewith.

(3) Since the size of the front latch members (161; 661) is different from the size of the rear latch members (162; 662), and the locations of the check pieces (163, 164; 663, 665) of said front and rear latch members are also different, a double-latch effect is achieved for the preferred embodiment of a latch bolt mechanism so as ensure locking security therewith.

The foregoing is considered as illustrative only of the principle of the present invention. Furthermore, since numerous modifications and changes will readily occur to those skilled in the art, it is not desired to limit the present invention to the exact construction and operation shown and described, and accordingly all suitable modifications and equivalents which may be resorted to, fall within the scope of the present invention as defined in the appended claims.

What is claimed is:

1. A sleeve-type latch bolt mechanism comprising:

lock-core means including a cylindrical body, having a round keyhole formed in a middle portion thereof, a plurality of vertical grooves separately provided in the periphery of said cylindrical body with an elongated slot being located in each one of said vertical grooves in communication with said round keyhole, a first and a second circular slot separately located around said cylindrical body and an annular member with a check block on a top side thereof fixedly provided at a front end of said cylindrical body for being operated to effect locking and unlocking operations therewith;

latch means composed of a plurality of different latch members and elastic members respectively disposed in a front and a rear portion of said vertical grooves of said cylindrical body in conjunction with said round keyhole thereof for providing different latching effects therewith;

positioning means including different annular positioning members, each having a plurality of outside and inside check pieces separately formed thereat, respectively disposed in the first and second annular slots of said cylindrical body in conjunction with said latch means, for effecting various check actions therewith;

a front sleeve member formed in a hollow body with a plurality of locating slots provided therein disposed around said cylindrical body in conjunction with said positioning means for keeping the same in position therein;

a rear sleeve member with a closed side having a round keyhole formed therein in conjunction with the round keyhole of said cylindrical body, and an open side connected to a rear end of said front sleeve member for being installed in a lock body to perform locking and unlocking operations therethrough; and a cylindrical-stem key with a stem having a plurality of different slots provided at one end thereof in conjunction with said latch means, and a stop ring provided at another end thereof for being inserted into the round keyhole of said cylindrical body through the round keyhole of said rear sleeve member, so as to operate said latch means within said lock-core means; whereby, safe locking and unlocking operations are achieved accordingly wherein said latch means further comprises:

a plurality of front latch members, each of which includes a check piece provided at a back side thereof, and a reference slot, together with a plurality of dummy slots positioned parallel with said reference slots, located in a front side thereof, respectively installed in a front portion of said vertical grooves of said cylindrical body with said check pieces extending into the round keyhole through the elongated slots of said cylindrical body to engage with a front portion of the stem of said cylindrical-stem key within the round keyhole of said cylindrical body;

a plurality of rear latch members, each of which is provided with a check piece at a back side, and a reference slot, together with a plurality of dummy slots positioned parallel with said reference slots, in a front side of each said rear latch member, respectively installed in a rear portion of said vertical grooves with said check pieces of said rear latch members extending into the round keyhole through the elongated slot of said cylindrical body for engaging with a rear portion of the stem of said cylindrical-stem key within the round keyhole of said cylindrical body;

each of said front latch members having a cross section thereof which is larger than that of said rear latch members so as to enable the check pieces of both latch members to protrude at different lengths into the round keyhole through the elongated slots of said cylindrical body; and a plurality of springs separately disposed between each front and rear latch members in conjunction with the annular member of said cylindrical body and said front and rear sleeve member for effecting elastic actions in conjunction with locking and unlocking operations through the stem of said cylindrical-stem key.

2. A sleeve-type latch bolt mechanism according to claim 1 wherein said positioning means comprises:

a first and a second annular positioning member, each having a plurality of outside check lugs formed at an outer perimeter thereof and extending in opposite directions therefrom for being respectively engaged with the locating slots of said front sleeve member, and a plurality of inside check lugs opposingly extending from an inner perimeter thereof for being respectively located in the first and second circular grooves of said cylindrical body wherein the diameter of said first annular positioning member is smaller than that of said second annular positioning member so as to be properly joined with said front sleeve member.

3. A sleeve-type latch bolt mechanism comprising:

lock-core means composed of a cylindrical body, including a round keyhole formed in a middle portion thereof, a plurality of vertical grooves separately provided in the periphery of said cylindrical body with a rear portion of each one of said vertical grooves being open to said round keyhole and an elongated slot located in a front portion of each of said vertical grooves being in communication with said round keyhole, a first and a second circular slot separately provided around said cylindrical body, and an annular member with a check block on a top side thereof fixedly provided at a front end of said cylindrical body for being operated to effect locking and unlocking operations therewith;

latch means including a plurality of different latch members and elastic members respectively disposed in front and rear portions of said vertical grooves of said cylindrical body in conjunction with said round keyhole thereof for providing different latching effects therewith wherein said latch means further comprises:

a plurality of front latch members, each of which includes a check piece, provided at a back side thereof, and a reference slot, together with a plurality of dummy slots in parallel with said reference slots, located in a front side thereof, respectively installed in a front portion of said vertical grooves of said cylindrical body with said check pieces extending into the round keyhole through the elongated slots located in the front portion of the vertical grooves of said cylindrical body for making engagement with a front portion of the stem of said cylindrical-stem key within the round keyhole of said cylindrical body;

a plurality of rear latch members, each of which is provided with a notch at a back side thereof, a check piece located in said notch and a reference slot, together with a plurality of dummy slots positioned parallel with said reference slot, provided in a front side thereof, respectively installed in a rear portion of said vertical grooves with said notches and check pieces thereof extending into the round keyhole through the rear open portions of the vertical grooves of said cylindrical body for making engagement with a rear portion of the stem of said cylindrical-stem key within the round keyhole of said cylindrical body;

each of said front latch members having a cross section thereof which is larger than that of said rear latch members so as to enable the check pieces of both latch members to protrude at different lengths within the round keyhole of said cylindrical body;

a plurality of springs separately disposed between each of the front and rear latch members in conjunction with the annular member of said cylindrical body and said front and rear sleeve members for effecting elastic actions in conjunction with locking and unlocking operations of the stem of said cylindrical-stem key; and positioning means including a different annular positioning members each having a plurality of outside and inside check pieces separately formed thereat respectively disposed in the first and second annular slots of said cylindrical body in conjunction with said latch means for effecting various checking actions therewith;

a front sleeve member formed in a hollow body with a plurality of locating slots provided therein disposed around said cylindrical body in conjunction with said positioning means for keeping the same in position therein;

a rear sleeve member with a closed side thereof, having a multi-opening keyhole formed therein in conjunction with the round keyhole of said cylindrical body, and an open side thereof with a plurality of locating slots provided therein connected to a rear end of said front sleeve for being installed in a lock body to perform locking and unlocking operations therethrough; and a cylindrical-stem key with a key stem thereof having a plurality of step-type strips provided around said stem in conjunction with said cylindrical body and said latch means, and a circular opening formed over a top end of said step-type strips for being inserted into the round keyhole of said cylindrical body through the multi-opening keyhole of said rear sleeve member so as to operate said latch means within said lock-core means; whereby, safe locking and unlocking operations are achieved accordingly.

4. A sleeve-type bolt mechanism according to claim 3 wherein said front sleeve member further comprises a larger bore in a rear portion thereof and a smaller bore in a front portion thereof so as to be matched with said first and second annular positioning members around an outside of said cylindrical body for achieving check effect therewith.

5. A sleeve-type latch bolt mechanism according to claim 3 wherein said positioning means comprises:

a first and a second annular positioning members, each having a plurality of outside check lugs formed at the outer perimeter thereof and extending in opposite direction therefrom for being respectively engaged with the locating slots of said front sleeve member, and a plurality of inside check lugs opposingly extending from the inner perimeter thereof for being respectively located in the first and second circular grooves of said cylindrical body, wherein the diameter of said first annular positioning member is smaller than that of said second annular positioning member so as to be properly joined with said front and rear sleeve members.

6. A sleeve-type bolt mechanism according to claim 3 wherein said front sleeve member has an external diameter identical to that of said rear sleeve member, and an internal diameter smaller than that of said rear sleeve member so as to be matched with said first and second annular positioning members around the outside of said cylindrical body for achieving a checking effect therewith.

* * * * *